US010119185B2

(12) United States Patent
Takada et al.

(10) Patent No.: US 10,119,185 B2
(45) Date of Patent: Nov. 6, 2018

(54) LOW SPECIFIC GRAVITY STEEL FOR FORGING USE EXCELLENT IN MACHINEABILITY

(75) Inventors: Hiromasa Takada, Tokyo (JP); Suguru Yoshida, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 1100 days.

(21) Appl. No.: 13/138,534

(22) PCT Filed: Apr. 8, 2010

(86) PCT No.: PCT/JP2010/056721

§ 371 (c)(1),
(2), (4) Date: Aug. 30, 2011

(87) PCT Pub. No.: WO2010/119911

PCT Pub. Date: Oct. 21, 2010

(65) Prior Publication Data

US 2011/0318218 A1 Dec. 29, 2011

(30) Foreign Application Priority Data

Apr. 14, 2009 (JP) ..... 2009-098175

(51) Int. Cl.

| | |
|---|---|
| ***C22C 38/18*** | (2006.01) |
| ***C22C 38/00*** | (2006.01) |
| ***C22C 38/02*** | (2006.01) |
| ***C22C 38/06*** | (2006.01) |
| ***C22C 38/38*** | (2006.01) |

(52) U.S. Cl.

CPC ..... *C22C 38/001* (2013.01); *C22C 38/02* (2013.01); *C22C 38/06* (2013.01); *C22C 38/38* (2013.01)

(58) Field of Classification Search

CPC ..... C22C 38/001; C22C 38/02; C22C 38/04; C22C 38/06; C22C 38/14; C22C 38/18; C22C 38/26; C22C 38/28; C22C 38/38; C22C 38/60

USPC ..... 420/77, 79, 81, 87, 103, 104, 120, 420/126–128; 148/333, 337

See application file for complete search history.

(56) References Cited

U.S. PATENT DOCUMENTS

| | | | | |
|---|---|---|---|---|
| 4,865,662 | A * | 9/1989 | Zimmer et al. | 148/329 |
| 4,875,933 | A * | 10/1989 | Wan | C22C 38/06 420/129 |
| 6,358,338 | B1 * | 3/2002 | Guelton et al. | 148/547 |
| 8,394,213 | B2 * | 3/2013 | Meurer | 148/530 |
| 2006/0013720 | A1 | 1/2006 | Hashimura et al. | |
| 2008/0070060 | A1 * | 3/2008 | Suzuki et al. | 428/659 |
| 2008/0247902 | A1 * | 10/2008 | Scheller et al. | 420/93 |
| 2009/0053556 | A1 * | 2/2009 | Sohn | C23C 2/06 428/659 |

FOREIGN PATENT DOCUMENTS

| | | |
|---|---|---|
| CN | 1711367 | 12/2005 |
| JP | 57-181363 | 11/1982 |
| JP | 2002-363704 | 12/2002 |
| JP | 2004-68098 | 3/2004 |
| JP | 2005-15909 | 1/2005 |
| JP | 2005-120399 | 5/2005 |
| JP | 2005-325388 | 11/2005 |
| JP | 2006-348321 | 12/2006 |

OTHER PUBLICATIONS

Higgins, Raymond A., "Impurities in Steel", Engineering Metallurgy—Applied Physical Metallurgy, 1993, Elsevier, Sixth Edition, p. 239-264.*

International Search Report dated Jul. 6, 2010 issued in corresponding PCT Application No. PCT/JP2010/056721.

Search Report dated Mar. 21, 2014 issued in corresponding European Patent Application No. EP 10764495.

* cited by examiner

*Primary Examiner* — Jie Yang

(74) *Attorney, Agent, or Firm* — Birch, Stewart, Kolasch & Birch, LLP

(57) ABSTRACT

Steel for forging having high strength and superior machinability due to controlled cooling immediately after shaping by hot forging followed by tempering and having a lower specific gravity than ordinary steel for forging use, the steel containing C: 0.05 to 0.50%, Si: 0.01 to 1.50%, Mn: 3.0 to 7.0%, P: 0.001 to 0.050%, S: 0.020 to 0.200%, Al: 3.0 to 6.0%, Cr: 0.01 to 1.00%, and N: 0.0040 to 0.0200% and having a balance of Fe and unavoidable impurities.

4 Claims, No Drawings

LOW SPECIFIC GRAVITY STEEL FOR FORGING USE EXCELLENT IN MACHINEABILITY

This application is a national stage application of International Application No. PCT/JP2010/056721, filed Apr. 8, 2010, which claims priority to Japanese Application No. 2009-098175 filed Apr. 14, 2009, which is incorporated by reference in its entirety.

TECHNICAL FIELD

The present invention relates to low specific gravity steel for forging use superior in machinability used for auto parts, machine structural parts, etc.

BACKGROUND ART

In recent years, where protection of the global environment has been sought, reduction of exhaust gas from automobiles, a major factor in air pollution and global warming, in particular reduction of the amount of exhaust of carbon dioxide per unit distance traveled, has become an urgent task. In order to reduce the amount of exhaust of carbon dioxide, fuel consumption has to be lowered. To lower fuel consumption, reduction of the weight of vehicles is extremely effective.

For forged parts and machined parts of ferrous materials used for the engine and chassis among auto parts, in the past, carbon steel, alloy steel, and V-containing microalloyed steel have been used. These steels have compositions of 97% or more of Fe and elements such as Mn, Cr, and V having specific gravities equal to or greater than that of Fe, and therefor these steels have specific gravities of around 7.8.

Auto parts had been reduced in weight by strengthening the steel and thereby enabling increased thinness or changes in part shapes based on the assumption of a constant specific gravity of the materials. However, in recent years, reduction of the specific gravity of steel has been studied. Several proposals have been made regarding low specific gravity steel mainly comprised of Fe.

As examples of low specific gravity steel mainly comprised of Fe, for example, there are the automobile-use steel sheets containing large amounts of Al described in PLTs 1 and 2. PLT 1 describes high strength, low specific gravity steel sheet containing C: over 0.01 to 5%, Si: 3.0% or less, Mn: 0.01 to 30.0&, P: 0.1% or less, S: 0.01% or less, Al: 3.0 to 10.0%, and N: 0.001 to 0.05% and having a specific gravity of <7.20 and a value TS×El of a product of tensile strength TS (MPa) and elongation at break El (%) of 10000 MPa·% or more. Further, PLT 2 discloses high strength, low specific gravity steel sheet having a similar composition to the steel sheet of PLT 1, having Al of over 10 to 32.0%, and, furthermore, having a low specific gravity.

The steel sheets of the PLTs 1 and 2 are produced by treating Al-containing steel which contains a trace of P and S reduced in elements which make grain boundary embrittle, are produced through structure refinement process such as recrystallization by setting final rolling temperature at 950 to 960° C., and adjusting the coiling temperature to improve the workability of the steel sheets. As a result, the steel sheets have sufficient ductility. In this way, in a steel sheet produced by hot rolling, the structure can be made finer by controlling the rolling conditions in the rolling process, so it is possible to produce steel containing a relatively large amount of Al as a raw material.

On the other hand, the general process of hot forging comprises only heating a steel bar to a temperature of about 1200° C. or more, then forging it finishing at about 1100° C., then cooling it in accordance with the properties of the steel material. So, when the steel containing a large amount of Al is hot forged, such a structural control done with steel sheet is not possible in forging process, so the structure after forging becomes coarse and the strength and toughness become inferior.

Rolled steel sheet and hot forged products have the above such differences, so not all of the steels described in PLTs 1 and 2 can be applied as materials for hot forging use. Furthermore, even if the steel can be hot forged, the machinability, which is necessary for steel for forging use, is not sufficient.

For example, in forged parts such as automobile chassis parts, a high tensile strength of 800 MPa or more is demanded and, at the same time, superior machinability enabling mass production is required, in many cases. In the steels described in PLTs 1 and 2, the machinability is not considered at all. In particular, in the case assuming machining, the amount of S is completely insufficient.

Furthermore, as another example, there is the iron alloy described in PLT 3. PLT 3 describes a low specific gravity iron alloy comprised of Mn: 5.0 to less than 15.0%, Al: 0.5 to 10.0%, Si: 0.5 to 10.0%, and C: 0.01 to 1.5% and provided with a $\gamma+\alpha$ two-phase structure having an $\alpha$ phase fraction of 10 to 95%.

In this iron alloy, Al is increased to reduce the specific gravity and furthermore mainly the Mn is raised to stabilize the $\gamma$ phase and finally form a $\gamma+\alpha$ two-phase structure having 10 to 95% of an $\alpha$ phase. By this, a high specific strength and workability are obtained. In particular, a superior cold workability is obtained with an $\alpha$ fraction of about 60% or less. The hardness and cold workability of this iron alloy are largely dependent on the ratio of $\gamma$ and $\alpha$. For industrial use, it is necessary to stably adjust the ratio of $\gamma$ and $\alpha$. However, it is extremely difficult to precisely obtain the targeted $\gamma/\alpha$ ratio hot working and various heat treatment processes. There is therefore the problem that iron alloy and the production process described in PLT 3 is not suited to industrial production. Furthermore, this alloy has as its object to obtain a superior hardness. It does not contain S and does not consider machinability at all.

Above, Al-containing steels for various structural uses were explained. Viewing Al-containing steels as a whole, the main applications utilize their corrosion resistance, high temperature oxidation resistance, and vibration damping properties. As one example, PLT 4 may be mentioned. PLT 4 discloses an Fe—Mn—Al alloy as an inexpensive alternative steel to stainless steel.

CITATION LIST

Patent Literature

PLT 1: Japanese Patent Publication (A) No. 2005-15909
PLT 2: Japanese Patent Publication (A) No. 2005-120399
PLT 3: Japanese Patent Publication (A) No. 2005-325388
PLT 4: Japanese Patent Publication (A) No. 57-181363

SUMMARY OF INVENTION

Technical Problem

The present invention has as its object the proposal of steel for hot forging use which exhibits high strength and superior machinability after being shaped by hot forging and then cooled in that state at an appropriate speed and which has a lower specific gravity than ordinary steel for forging use.

Solution to Problem

In the past, steel containing relatively large amounts of Al was not used as a forging material, which requires strength and toughness, because when large amounts of Al is added to steel aiming a lower specific gravity, the austenite transformation which occurs at a high temperature ordinary steels no layer occurs and therefor, it is not possible to use transformation to make the structure finer at the time of heating and cooling and therefore the structure become a coarse ferrite structure from a high temperature to room temperature. This coarse ferrite structure steel suffers from forging cracks and surface defects at the time of hot forging and becomes inferior in mechanical properties at room temperature, so cannot be used for forging use.

Therefore, the inventors studied the compositions of Al-containing steels at which austenite is stably formed at the high temperature of the hot forging temperature region.

As a result, the inventors have discovered the optimum chemical composition of steel ingredients containing an amount of Al resulting in a sufficiently low specific gravity compared with ordinary steel for forging use, enabling an austenite phase to be stably emerged in the heating temperature region of hot forging, and not causing deterioration of the mechanical properties when used as a forged part.

The inventors have further studied the machineability—an important property of forged parts, and learned that steel containing a relatively large amount of Al exhibits an extremely superior machineability, that is, superior tool life. The gist of the present invention, made as a result of the above study, is as follows:

(1) Low specific gravity steel for forging use superior in machinability characterized by containing, by mass %, C: 0.05 to 0.50%, Si: 0.01 to 1.50%, Mn: 3.0 to 7.0%, P: 0.001 to 0.050%, S: 0.020 to 0.200%, Al: 3.0 to 6.0%, Cr: 0.01 to 1.00%, and N: 0.0040 to 0.0200% and having a balance of Fe and unavoidable impurities.

(2) Low specific gravity steel for forging use superior in machinability as set forth in (1) further containing, by mass %, one or more of V: 0.05 to 0.30%, Nb: 0.05 to 0.30%, and Ti: 0.005 to 0.050%.

Advantageous Effects of Invention

According to the present invention, it is possible to provide low specific gravity steel for forging use provided with sufficient strength and toughness for auto parts and other machine structural parts and superior in machinability.

EMBODIMENT OF INVENTION

In the present invention, the inventors studied the steel composition of steel with the view to give the steel γ phase in the process of heating to the ordinary forging temperature of 1200° C. and in the process of cooling from 1200° C., and to secure machinability. As a result, the inventors discovered the optimal contents of C, Mn, and Al for obtaining an austenite phase and the optimal contents of S etc. for securing machinability. Below, the limiting conditions of the steel composition of the present invention will be explained. Note that, % means mass %.

C: 0.05 to 0.50%

C is an essential element for raising the strength of the forged product and for broadening the temperature range of austenite single phase transform at the heating for hot forging and thereby enabling stable work. For this purpose, 0.05% or more is necessary, but if over 0.50%, the strength excessively rises and the ductility falls, so this is not preferable. The more preferable range of C is 0.15 to 0.45%.

Si: 0.01 to 1.50%

Si acts as a solution strengthening element if 0.01% or more is added. A large amount of Si is also an action of reduction of the specific gravity. However, addition of over 1.50% causes a decrease in the toughness and ductility. The more preferable range of Si is 0.05 to 0.50%.

Mn: 3.0 to 7.0%

Mn is known as an austenite-forming element in steel and is added in the present invention as well for the purpose of transforming the structure to austenite at the time of heating for forging. To make all or part of the structure transform to austenite, 3.0% or more is necessary. If the amount of Mn becomes greater, the amount of transformation to austenite at the time of heating for forging also increases by that amount, but if the content of Mn exceeds 7.0%, it will cause excessive strengthening of the steel and a drop in the machinability, so the upper limit is made 7.0%.

P: 0.001 to 0.050%,

P, even if slight, reduces the amount of austenite transformation at the time of heating. At the general production range of 0.050% or less, the effect resulting from this is small, so the upper limit is made 0.050%. Further, due to the restrictions in steelmaking technology, the lower limit is made 0.001%.

S: 0.020 to 0.200%,

S, in the steel of the present invention, completely disperses and precipitates in the steel as the compound MnS and improves the machinability. Further, the precipitated MnS particles have the effect of suppressing the coarsening of the structure at the time of high temperature heating and improving the strength and ductility of the steel. To secure the MnS particles required for improving the machinability, addition of 0.020% or more of S is necessary. On the other hand, addition of over 0.200% causes coarsening of the MnS particles, so invites a drop in toughness. The more preferable range of S is 0.030 to 0.100%.

Al: 3.0 to 6.0%

Al is an element which causes a reduction in the specific gravity of steel and improves the machinability. When the amount of addition of Al is increased, the specific gravity of the steel falls correspondingly. However, if adding an excessive amount, no austenite transformation occurs at all at the time of heating, the structure of steel becomes ferrite from room temperature to the liquidus temperature, and the ferrite structure after hot forging becomes extremely coarse. As a result, cracking and surface defect easily occur at the forging process and the toughness and ductility in the forging product become extremely low.

The V-containing microalloyed steel used for hot forging must have at least 3.0% of Al in order to secure an at least 4% or more reduction in the specific gravity. Further, to make the structure after hot forging sufficiently fine and obtain superior toughness and ductility, at least part of the structure has to transform to austenite in the process of heating to the ordinary forging heating temperature of 1200° C. For that reason, the amount of Al has to be made 6.0% or less. For this reason, the range of content of Al is made 3.0 to 6.0%.

Furthermore, steel containing the above range of Al acts to improve the tool life at the time of machining. During metal machining, it is known that, the machined material sticks to the tool and is sloughed away resulting in wear of the cutting tool, but in the steel of the present invention, the Al contained in the steel acts to form a stable protective film on the tool during machining and prevent sticking. It is believed that the tool life is extended for that reason.

Cr: 0.01 to 1.00%

Cr is a solution strengthening element in the range of the steel composition of the present invention. For strengthening the steel, 0.01% or more is added. However, to keep down the costs, the content is limited to 1.0% or less.

N: 0.0040 to 0.0200%

N forms AlN and has the action of preventing coarsening of the structure during heating and thereby improving the toughness and ductility. To prevent coarsening of the structure, at least 0.0040% or more is necessary. However, to obtain a sound cast structure with no voids, the upper limit is made 0.0200%.

The present invention is based on steel having the above composition of ingredients and having a balance of unavoidable impurities, but may further selectively contain one or more of V: 0.05 to 0.30%, Nb: 0.05 to 0.30%, and Ti: 0.005 to 0.050%.

V, Nb, and Ti all form carbonitrides and prevent coarsening of the structure at the time of heating. To obtain the amount of carbonitrides necessary for preventing coarsening of the structure, with V, 0.05% or more must be added, with Nb, 0.05% or more, and with Ti, 0.005% or more. However, if adding large amounts, the carbonitrides coarsen and a drop in the toughness and ductility is caused, so the upper limits of the elements are made 0.30% for V, 0.30% for Nb, and 0.050% for Ti.

Note that in the processing of heating the steel to the general casting heating temperature of around 1200° C. and the process of cooling from around 1200° C., to make the area percentage of the austenite structure greater, the contents of C, Si, Mn, and Al are preferably in a range satisfying the following (formula 1):

$$-3.3\times\%\ C+0.2\times\%\ Si-0.31\times\%\ Mn+0.17\times\%\ Al+0.62\leq 0 \quad \text{(formula 1)}$$

Note that the coefficients and constants of the elements are determined based on experiments.

EXAMPLES

Steels containing the alloy elements described in Table 1 and having balances of Fe and unavoidable impurities were cast into 150 kg ingots using a vacuum melting furnace. These ingots were heated to 1230° C. and elongated by forging to steel bars of a cross-sectional size of 30 mm square for use as starting materials for the tests. The starting material 30 mm square steel bars were cut into 200 mm lengths, inserted into a 1200° C. furnace for 20 minutes for soaking for the purpose of reproducing hot forged products, then were taken out from the furnace, oil cooled, then tempered at 600° C. for 1 hour for use as test materials.

After that, the test materials were measured for Vicker's hardness at positions of a depth of 7.5 mm from the surface on the cross sections of the test materials. Further, test pieces for tensile tests and test pieces for impact tests (cross-section 10×10 mm, 1.0 mmR−2 mm depth notches) were taken parallel to the length directions of the test materials and were measured for tensile strength and room temperature impact values.

Furthermore, for drilling use, the test materials were worked into 28×28×21 mm test pieces. The 28×28 mm surfaces were horizontal to the longitudinal direction of forged bar and were used as the drilling surfaces. In the drilling test, a 3.0 mm diameter drill was used at a drilling rate of 1 to 100 m/min, a feed rate of 0.25 mm/rev, and a projection amount of 45 mm to drill holes of 9 mm depth. The machining oil used was a water-soluble machining oil.

The drill tool life was evaluated by the maximum drilling rate VL1000 (m/mn) by which drilling is possible down to a cumulative hole depth of 1000 mm. The tool life of the obtained test steels was compared with the tool life in the case of drilling a carbon steel (S=0.050%) quenched and tempered material of the same tensile strength as the test steels and evaluated by the ratio of the two. Therefore, for example, a value of the ratio of "1.20" shows that when drilling the same 1000 mm, a test steel can be drilled at a rate 20% faster than heat-treated steel of the same hardness.

The results of the above measurements are shown in Table 2. From Table 2, it is learned that the steels of the present invention have specific gravities of 7.20 to 7.44. These specific gravities are specific gravities about 5 to 7% smaller than the specific gravity of ordinary V-containing microalloyed steel, for example, the 7.79 of S55CV. Further, for the mechanical properties after treatment simulating forging, a tensile strength over 800 MPa and a 0.2% proof strength over 700 MPa are exhibited. It is learned that a sufficient Charpy impact value for use for automobile chassis parts is provided. However, the machinability compared with VL1000 is at least 29% better than with heat-treated steel of the same hardness.

As opposed to this, in the steels of the comparative examples, as shown next, there was the problem that it was impossible to obtain the desired mechanical properties. In Steel No. 18 with a smaller amount of C and Steel No. 18 with a smaller amount of Mn, both the yield strength and the tensile strength dropped. Further, the machinabilities were on a par with conventional steels. In Steel No. 20 with a larger amount of Si, the impact value was lower. In Steel No. 21 with a larger amount of Mn, superior mechanical properties were realized, but the alloying cost is high with Mn. In Steel No. 22 with a larger amount of P and in Steel No. 23 with a larger amount of S, the impact values became low.

In Steel No. 24 with a larger amount of Cr, the proof strength fell. In Steel No. 25 with a larger amount of Al, the proof strength and the impact value fell. In Steel. No. 26 with a smaller amount of N and in Steel No. 27 with a larger amount of N, the impact values fell. In Steel No. 29 with a larger amount of C and a smaller amount of S, the yield strength fell and no improvement in the machinability could be recognized.

TABLE 1

(mass %)

| No. | C | Si | Mn | P | S | Cr | Al | N | V, Nb, Ti | A value (%) | Note |
|---|---|---|---|---|---|---|---|---|---|---|---|
| 1 | 0.20 | 0.05 | 5.0 | 0.004 | 0.020 | 0.04 | 4.0 | 0.0042 | | −0.90 | Inv. ex. |
| 2 | 0.40 | 0.05 | 5.0 | 0.010 | 0.024 | 0.05 | 4.0 | 0.0054 | | −1.56 | Inv. ex. |

TABLE 1-continued (mass %)

| No. | C | Si | Mn | P | S | Cr | Al | N | V, Nb, Ti | A value (%) | Note |
|---|---|---|---|---|---|---|---|---|---|---|---|
| 3 | 0.41 | 0.10 | 5.1 | 0.009 | 0.030 | 0.05 | 5.0 | 0.0051 | | −1.44 | Inv. ex. |
| 4 | 0.06 | 1.46 | 6.9 | 0.010 | 0.020 | 0.16 | 6.0 | 0.0085 | | −0.41 | Inv. ex. |
| 5 | 0.15 | 1.01 | 5.0 | 0.035 | 0.055 | 0.50 | 5.0 | 0.0196 | | −0.37 | Inv. ex. |
| 6 | 0.07 | 0.12 | 3.0 | 0.033 | 0.050 | 0.06 | 3.0 | 0.0098 | | −0.01 | Inv. ex. |
| 7 | 0.48 | 0.13 | 6.5 | 0.026 | 0.051 | 0.10 | 4.0 | 0.0121 | | −2.27 | Inv. ex. |
| 8 | 0.10 | 0.27 | 4.0 | 0.025 | 0.046 | 0.95 | 5.0 | 0.0087 | | −0.05 | Inv. ex. |
| 9 | 0.16 | 0.52 | 3.9 | 0.050 | 0.033 | 0.39 | 4.5 | 0.0134 | | −0.25 | Inv. ex. |
| 10 | 0.20 | 0.12 | 5.0 | 0.015 | 0.195 | 0.15 | 5.0 | 0.0114 | | −0.72 | Inv. ex. |
| 11 | 0.22 | 0.20 | 5.0 | 0.022 | 0.074 | 0.20 | 4.7 | 0.0130 | V: 0.29% | −0.82 | Inv. ex. |
| 12 | 0.18 | 0.55 | 4.5 | 0.004 | 0.033 | 0.05 | 4.5 | 0.0130 | Nb: 0.24% | −0.49 | Inv. ex. |
| 13 | 0.18 | 0.05 | 4.0 | 0.005 | 0.045 | 0.10 | 5.0 | 0.0080 | Ti: 0.026% | −0.35 | Inv. ex. |
| 14 | 0.16 | 0.12 | 3.7 | 0.015 | 0.044 | 0.15 | 5.3 | 0.0132 | V: 0.07%, Ti: 0.015% | −0.13 | Inv. ex. |
| 15 | 0.32 | 0.15 | 4.9 | 0.010 | 0.045 | 0.05 | 5.0 | 0.0151 | Nb: 0.13%, Ti: 0.024% | −1.08 | Inv. ex. |
| 16 | 0.31 | 0.16 | 5.5 | 0.015 | 0.044 | 0.11 | 4.4 | 0.0110 | V: 0.05%, Nb: 0.10% | −1.33 | Inv. ex. |
| 17 | 0.46 | 0.20 | 6.5 | 0.025 | 0.059 | 0.20 | 3.6 | 0.0132 | V: 0.05%, Nb: 0.08%, Ti: 0.015% | −2.26 | Inv. ex. |
| 18 | 0.02 | 0.05 | 3.0 | 0.020 | 0.054 | 0.15 | 4.5 | 0.0119 | | 0.40 | Comp. ex. |
| 19 | 0.20 | 0.15 | 2.4 | 0.022 | 0.055 | 0.20 | 5.5 | 0.0080 | | 0.18 | Comp. ex. |
| 20 | 0.45 | 2.00 | 4.0 | 0.018 | 0.010 | 0.21 | 5.5 | 0.0108 | | −0.77 | Comp. ex. |
| 21 | 0.45 | 0.35 | 8.5 | 0.021 | 0.060 | 0.16 | 5.9 | 0.0022 | | −2.43 | Comp. ex. |
| 22 | 0.41 | 1.25 | 3.5 | 0.070 | 0.023 | 0.15 | 4.5 | 0.0101 | | −0.80 | Comp. ex. |
| 23 | 0.30 | 0.12 | 4.5 | 0.016 | 0.266 | 0.17 | 4.5 | 0.0123 | | −0.98 | Comp. ex. |
| 24 | 0.45 | 0.55 | 4.0 | 0.020 | 0.053 | 2.00 | 6.0 | 0.0122 | | −0.98 | Comp. ex. |
| 25 | 0.30 | 0.40 | 4.5 | 0.023 | 0.071 | 0.15 | 7.0 | 0.0077 | | −0.50 | Comp. ex. |
| 26 | 0.50 | 0.10 | 7.0 | 0.015 | 0.063 | 0.10 | 4.0 | 0.0025 | | −2.50 | Comp. ex. |
| 27 | 0.18 | 0.10 | 3.5 | 0.016 | 0.061 | 0.09 | 5.0 | 0.0298 | | −0.19 | Comp. ex. |
| 28 | 0.45 | 0.35 | 3.5 | 0.021 | 0.060 | 0.16 | 5.9 | 0.0070 | V: 0.05%, Nb: 0.08%, Ti: 0.015% | −0.88 | Comp. ex. |
| 29 | 0.65 | 0.23 | 4.0 | 0.014 | 0.015 | 0.20 | 5.0 | 0.0086 | | −1.87 | Comp. ex. |

A value = 3.3 × % C + 0.2 × % Si − 0.31 × % Mn + 0.17 × % Al + 0.62

TABLE 2

| No. | Proof strength (MPa) | Tensile strength (MPa) | Impact value (J/cm$^2$) | Ratio of tool life | Specific gravity | Note |
|---|---|---|---|---|---|---|
| 1 | 916 | 1044 | 57 | 1.36 | 7.34 | Inv. ex. |
| 2 | 846 | 1065 | 51 | 1.55 | 7.35 | Inv. ex. |
| 3 | 953 | 1087 | 53 | 1.63 | 7.26 | Inv. ex. |
| 4 | 696 | 874 | 66 | 1.82 | 7.20 | Inv. ex. |
| 5 | 856 | 988 | 53 | 1.71 | 7.29 | Inv. ex. |
| 6 | 777 | 974 | 62 | 1.29 | 7.44 | Inv. ex. |
| 7 | 942 | 1120 | 55 | 1.43 | 7.34 | Inv. ex. |
| 8 | 847 | 1005 | 63 | 1.64 | 7.27 | Inv. ex. |
| 9 | 899 | 1011 | 64 | 1.60 | 7.29 | Inv. ex. |
| 10 | 840 | 1050 | 52 | 1.55 | 7.26 | Inv. ex. |
| 11 | 949 | 1143 | 54 | 1.53 | 7.29 | Inv. ex. |
| 12 | 953 | 1114 | 60 | 1.63 | 7.33 | Inv. ex. |
| 13 | 842 | 1050 | 59 | 1.63 | 7.30 | Inv. ex. |
| 14 | 829 | 997 | 67 | 1.70 | 7.26 | Inv. ex. |
| 15 | 782 | 925 | 71 | 1.64 | 7.28 | Inv. ex. |
| 16 | 875 | 1093 | 53 | 1.57 | 7.31 | Inv. ex. |
| 17 | 916 | 1127 | 55 | 1.43 | 7.41 | Inv. ex. |
| 18 | 527 | 610 | 123 | 1.11 | 7.29 | Comp. ex. |
| 19 | 472 | 787 | 36 | 1.02 | 7.22 | Comp. ex. |
| 20 | 722 | 890 | 23 | 1.23 | 7.26 | Comp. ex. |
| 21 | 875 | 1124 | 61 | 1.20 | 7.20 | Comp. ex. |
| 22 | 754 | 1053 | 36 | 1.35 | 7.31 | Comp. ex. |
| 23 | 830 | 1004 | 24 | 1.62 | 7.31 | Comp. ex. |
| 24 | 580 | 920 | 84 | 1.30 | 7.21 | Comp. ex. |
| 25 | 490 | 765 | 14 | 1.15 | 7.12 | Comp. ex. |
| 26 | 750 | 968 | 45 | 1.30 | 7.38 | Comp. ex. |
| 27 | 805 | 1004 | 20 | 1.33 | 7.26 | Comp. ex. |
| 28 | 481 | 821 | 18 | 1.05 | 7.21 | Comp. ex. |
| 29 | 522 | 922 | 23 | 0.98 | 7.26 | Comp. ex. |

INDUSTRIAL APPLICABILITY

The steel for forging use of the present invention is low in specific gravity and can contribute to reduction of the weight of machine structural parts and is provided with sufficient strength and toughness and is superior in machinability, so has great applicability.

The invention claimed is:

1. A steel for forging consisting of, by mass%,
C: 0.05 to 0.50%,
Si: 0.01 to 1.50%,
Mn: 5.1 to 5.5%,
P: 0.001 to 0.050%,
S: 0.020 to 0.200%,
Al: 3.6 to 6.0%,
Cr: 0.01 to 0.20%,
N: 0.0040 to 0.0200%, and
having a balance of Fe and unavoidable impurities,
wherein the specific gravity of the steel is 7.44 or less.

2. A steel for forging consisting of, by mass%,
C: 0.05 to 0.50%,
Si: 0.01 to 1.50%,
Mn: 5.1 to 5.5%,
P: 0.001 to 0.050%,
S: 0.020 to 0.200%,
Al: 3.6 to 6.0%,
Cr: 0.01 to 0.20%,
N: 0.0040 to 0.0200%, and
one or more of
V: 0.05 to 0.30%,
Nb: 0.05 to 0.30%,
Ti: 0.005 to 0.050%, and
having a balance of Fe and unavoidable impurities,
wherein the specific gravity of the steel is 7.44 or less.

3. A forged product obtained by hot-forging a steel ingot consisting of, by mass%,
C: 0.05 to 0.50%,
Si: 0.01 to 1.50%,
Mn: 5.1 to 7.0%,
P: 0.001 to 0.050%,
S: 0.020 to 0.200%, Al: 3.0 to 6.0%,
Cr: 0.01 to 0.20%,
N: 0.0040 to 0.0200%, and
having a balance of Fe and unavoidable impurities,
wherein $-3.3\times\%\ C+0.2\times\%\ Si-0.31\times\%\ Mn+0.17\times\%\ Al+0.62\leq 0$ (formula 1), and
wherein the specific gravity of the steel is 7.44 or less.

4. A forged product obtained by hot-forging a steel ingot consisting of, by mass%,
C: 0.05 to 0.50%,
Si: 0.01 to 1.50%,
Mn: 5.1 to 7.0%,
P: 0.001 to 0.050%,
S: 0.020 to 0.200%,
Al: 3.0 to 6.0%,
Cr: 0.01 to 0.20%,
N: 0.0040 to 0.0200%, and
one or more of
V: 0.05 to 0.30%,
Nb: 0.05 to 0.30%,
Ti: 0.005 to 0.050%, and
having a balance of Fe and unavoidable impurities,
wherein $-3.3\times\%\ C+0.2\times\%\ Si-0.31\times\%\ Mn+0.17\times\%\ Al+0.62\leq 0$ (formula 1), and
wherein the specific gravity of the steel is 7.44 or less.

* * * * *